United States Patent [19]

Van Den Plas et al.

[11] 4,328,445

[45] May 4, 1982

[54] HIGH-PRESSURE DISCHARGE LAMP

[75] Inventors: Roger J. Q. Van Den Plas; Josephus M. Ruts; Antonius J. G. C. Driessen, all of Eindhoven, Netherlands

[73] Assignee: U.S. Philips Corporation, New York, N.Y.

[21] Appl. No.: 132,352

[22] Filed: Mar. 20, 1980

[30] Foreign Application Priority Data

Apr. 4, 1979 [NL] Netherlands ..... 7902634

[51] Int. Cl.[3] ..... H01J 7/44; H01J 17/34; H01J 19/78; H01J 29/96

[52] U.S. Cl. ..... 315/46; 313/151; 313/146; 315/47; 315/74; 315/331; 315/332

[58] Field of Search ..... 315/46, 47, 49, 73, 315/74, 75, 104, 330, 331, 332; 313/151, 152, 146

[56] References Cited

U.S. PATENT DOCUMENTS

| | | | |
|---|---|---|---|
| 1,629,313 | 5/1927 | Ruttenauer | 313/151 |
| 2,156,369 | 5/1939 | Bay | 313/151 |
| 2,680,807 | 6/1954 | Hullegard | 313/151 X |
| 3,226,597 | 12/1965 | Green | 313/151 X |
| 3,872,340 | 3/1975 | Collins | 315/73 |
| 4,179,640 | 12/1979 | Larson et al. | 315/73 |

*Primary Examiner*—Saxfield Chatmon, Jr.
*Attorney, Agent, or Firm*—Robert S. Smith

[57] ABSTRACT

The invention relates to a discharge lamp which has a discharge vessel provided with an external auxiliary electrode. The lamp also has a bimetal which in the inoperative condition of the lamp causes the external auxiliary electrode to bear against the discharge vessel. According to the invention the auxiliary electrode is connected to an end of only one bimetallic strip and in the operating condition of the lamp the auxiliary electrode is remote for the greater part from the discharge vessel due to the action of the bimetal. Combined with an operating condition of the lamp in which no hindrance is experienced from the auxiliary electrode.

6 Claims, 3 Drawing Figures

HIGH-PRESSURE DISCHARGE LAMP

The invention relates to a high-pressure discharge lamp including a discharge vessel having an ionizable filling and at least two main electrodes between which the discharge is maintained in the operating condition of the lamp, said discharge vessel being provided with an elongate external ignition auxiliary means which near one end is connected to a bimetallic strip and in the operating condition of the lamp is connected electrically to one of the main electrodes only. The bimetallic strip is situated near the other main electrode and the external ignition auxiliary means in the inoperative condition of the lamp bears against the discharge vessel over substantially its entire length, whereas in the operating condition of the lamp the ignition auxiliary means is remote from the discharge vessel at least for the greater part due to the action of the bimetallic strip.

A known lamp of the kind described has the advantage that in the operating condition of the lamp the external ignition auxiliary means does not engage the discharge vessel. As a result of this it is achieved that in the operating condition of the lamp the external ignition auxiliary means intercepts less radiation emitted by the lamp, while the life of the lamp is also favorably influenced because, as a result of this not engaging the vessel migration is counteracted of an element taking part in the discharge. In this known lamp the external ignition auxiliary means is also connected at its other end to a further bimetallic strip in which due to the collective action of the two bimetallic strips the external ignition auxiliary means in the operating condition of the lamp is remote from the discharge vessel. However, a construction of an external ignition auxiliary means having a member at each end which moves it is complicated.

According to the invention, a high-pressure discharge lamp of the kind mentioned in the opening paragraph is characterized in that the said bimetallic strip is the only member moving the external ignition auxiliary means. The advantage of the lamp according to the invention is that a movable member is connected only at one end of the external ignition auxiliary means.

The invention is based on the recognition of the fact that, for counteracting migration of an element taking part in the discharge, it is sufficient for the external ignition auxiliary means to be remote from the discharge vessel only for its greater part, namely in the region where the discharge takes place inside the discharge vessel and where large voltage differences occur between the auxiliary external ignition means and the discharge. The auxiliary external ignition means may be formed by a rod-shaped member of which one end is secured to the bimetallic strip while the other end is freely movable. However, the auxiliary external ignition means is preferably connected at its other end to a current supply conductor of one of the main electrodes. The preferred embodiment has for its advantage that the auxiliary external ignition means may be formed from thin wire.

In a further preferred embodiment of a lamp in accordance with the invention having an elongate discharge vessel, the auxiliary external ignition means in the inoperative condition of the lamp forms at most half a turn around the discharge vessel and the direction of movement of the bimetallic strip extends through a plane parallel to the longitudinal axis of the discharge vessel, the orientation of the bimetallic strip being such that when the temperature rises, movement of the movement of one end auxiliary ignition auxiliary means takes place.

In yet a further embodiment of a lamp in accordance with the invention having an elongate discharge vessel, the auxiliary external ignition means in the inoperative condition of the lamp forms at most three quarters of a turn around the discharge vessel and the direction of movement of the bimetallic strip is substantially perpendicular to the longitudinal axis of the discharge vessel, the orientation of the bimetallic strip being such that when the temperature rises, movement of the movement of one end auxiliary ignition means takes place.

A lamp according to one of the two last-mentioned embodiments has the advantage that the auxiliary external ignition means in the inoperative condition of the lamp bears against the discharge vessel over substantially its whole length even if the longitudinal axis of the discharge vessel is slightly curved.

A lamp in accordance with the invention may have a glow starter, which starter is switched off in the operating condition of the lamp by means of a separate switch.

An advantageous embodiment of a lamp in accordance with the invention comprises a series arrangement consisting of an electric contact which can be operated by the bimetallic strip and a glow starter which in the inoperative condition of the lamp interconnects the two main electrodes electrically via the bimetallic strip, while in the operating condition of the lamp the interconnection is broken due to the action of the bimetallic strip. An advantage of such a lamp is that two functions are performed by the bimetallic strip.

A high-pressure discharge lamp in accordance with the invention may be, for example a high-pressure mercury vapor discharge lamp but is preferably a high-pressure sodium vapor discharge lamp and the discharge vessel contains xenon which at a temperature of 3000 K. has a partial gas pressure which exceeds 15,000 Pa (120 Torr). This preferred lamp has the advantage of a large luminous flux and good ignition properties while substantially no shortening of the life occurs by sodium migration.

An external ignition auxiliary means may be constructed as an auxiliary electrode but may also be constructed as a heating element.

Embodiments of the invention will now be described in greater detail with reference to the drawings. In the drawings.

Figure 1:
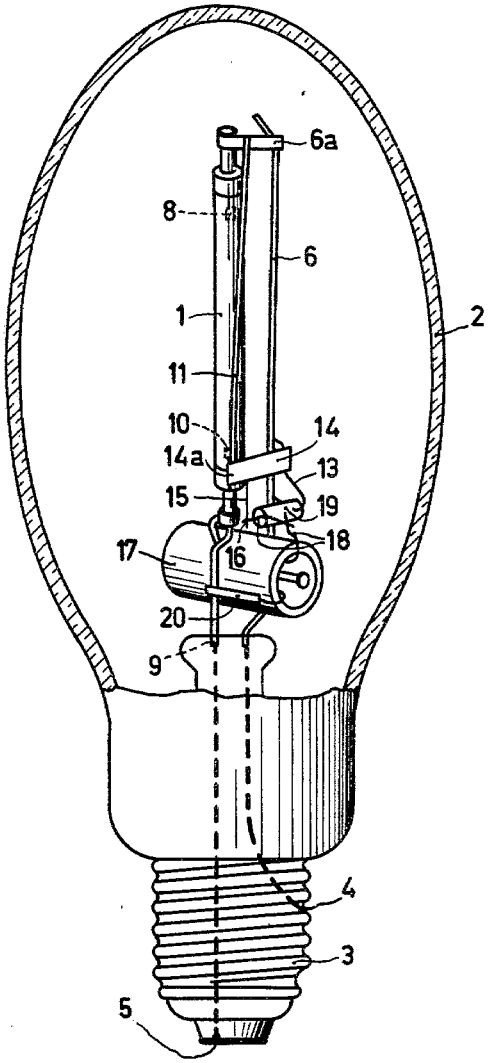
FIG. 1 is an elevation, partly broken away, of a lamp according to the invention in the inoperative condition in which the bimetallic strip is movable in a manner such that at least a portion remains in a plane perpendicular to the longitudinal axis of the discharge vessel.

Reference numeral 1 in FIG. 1 denotes a discharge vessel which is surrounded by an envelope 2 which has a lamp cap 3 and two connection terminals 4 and 5. The connection terminal 4 is connected to one end of a rigid current conductor 6. A current conductor 6*a* which leads to an internal main electrode 8 of the discharge vessel 1 is connected to the other end of the rigid current conductor 6. Connection terminal 5 is connected to a current conductor 9 which is connected to a second internal main electrode 10 of the vessel 1. An auxiliary electrode 11 is provided on the outside of the discharge vessel 1 and is conductively connected at one end to the current conductor 6*a* and is wound around the discharge vessel by one quarter of a turn.

A bimetallic strip 14 one end 14*a* of which is secured to the auxiliary electrode 11 is connected to the rigid current conductor 6 by means of a connection brace 13. In the inoperative condition of the lamp, the bimetallic strip 14 is in such a position that the auxiliary electrode 11 bears against the discharge vessel substantially throughout its length.

A rod-shaped projection 15, preferably made of tungsten, is secured to the bimetallic strip 14 and in the inoperative condition of the lamp bears against a conductor 18 at the area of a connection contact 16. The conductor 18, which bears on the current conductor 6 via a glass bead 19 and the supporting brace 13, is connected to a glow starter 17. The glow starter 17 is connected to a current conductor 9 via a conductor 20.

Figure 2:
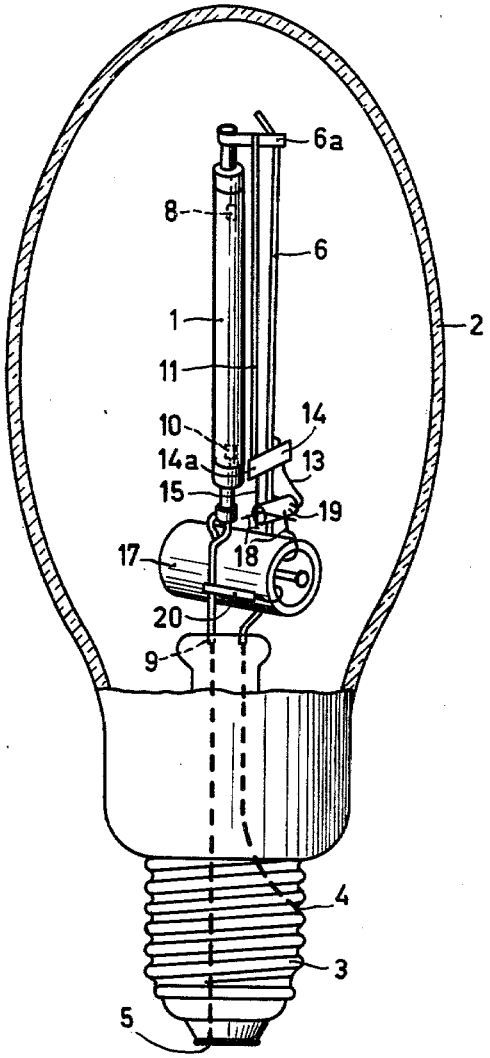
FIG. 2 shows the lamp of FIG. 1 in its operating condition.

FIG. 2 shows the lamp of FIG. 1 in the operating condition. The bimetallic strip 14 is extends away from the discharge vessel 1 and extends through a plane perpendicular to the longitudinal axis of the discharge vessel 1 through the travel thereof. The auxiliary electrode is also disconnected from the discharge vessel, when the glow starter is also switched off because the conductor 15 no longer bears against the conductor 18.

Figure 3:
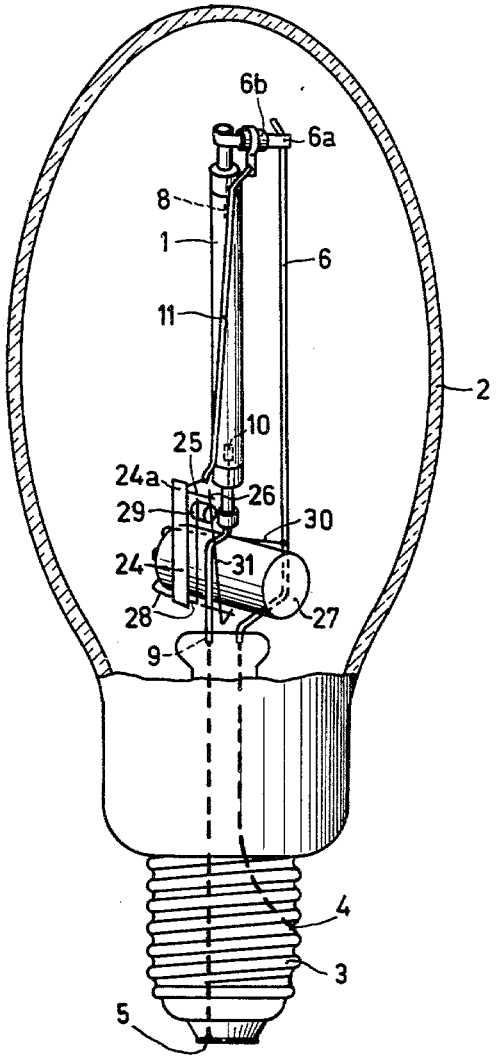
FIG. 3 shows a second lamp in accordance with the invention having a bimetallic strip the direction of movement of which is substantially in a plane parallel to the longitudinal axis of the discharge vessel.

FIG. 3 shows a modified embodiment of a lamp in accordance with the invention in which corresponding components are referred to by the same reference numerals as in FIG. 1. The auxiliary electrode 11 is connected at one end to the current conductor 6*a* by a capacitor 6*b*. The auxiliary electrode 11 forms a quarter of a turn around the discharge vessel and is connected with its other end to one end 24*a* of the bimetallic strip 24. The strip 24 is connected to conductor 28 and has a rod-shaped projection 25 which, in the inoperating condition of the lamp, bears at the ara of the connection contact 26 against a conductor 31 which is connected to the current conductor 9. The conductor 28 is supported on the current conductor 9 via a glass bead 29 and the conductor 31 and is connected to the glow starter 27. The glow starter 27 is connected to the current conductor 6 via a conductor 30.

The lamps described relate to high-pressure sodium vapor discharge lamps of approximately 50 Watts, in which xenon is also present in the discharge vessel at a pressure of $26.10^3$ Pa (200 Torr) at 300 K. Via a stabilization ballast of approximately 0.7 H, not shown, the lamps are connected to a supply source of 220 V, 50 Hz. Substantially no sodium migration occurred in the lamps described. The length of the discharge vessel in the lamps described is approximately 45 mm, the distance between the main electrodes is approximately 27 mm, while the auxialiary electrode in the inoperative condition of the lamp bears against the discharge vessel over a length of approximately 36 mm.

The operation of the lamps described will now be explained with reference to FIG. 1 and FIG. 2. When the lamp is connected to the said voltage source via the stabilization ballast, a glow discharge will first be formed in the glow starter 17. As a result of this heat is evolved so that the two contacts in the glow starter will bend towards each other and finally make contact. A current will then flow in the circuit 4, 6, 13, 14, 15, 16, 18, 17, 20, 9, 5. The glow starter will then cool so that its contacts will move apart after some time. This switching off of the glow starter causes a voltage pulse of approximately 2000 V which, via the rod-shaped projection 15 and the bimetal 14 is applied between the main electrodes 8 and 10 and between the main electrode 10 and the auxiliary electrode 11. As a result of this, an electric field is generated in the discharge vessel, whereupon the discharge ignites between the main electrodes 8 and 10. If this does not occur the first time, the process with the glow starter is repeated.

Once the discharge between the main electrodes 8 and 10 has been ignited, the bimetallic strip 14 will be heated by the consequent heat so that the strip will bend away from the discharge vessel 1. The result of this is that the auxiliary electrode 11 will bend due to the bimetallic strip and will move away from the discharge vessel. The glow starter 17 will also be switched off.

What is claimed is:

1. A high-pressure discharge lamp including a discharge vessel having an ionizable filling and at least two main electrodes between which the discharge is maintained in the operating condition of the lamp, said discharge vessel being provided with an auxiliary elongate external ignition means which near one end is connected to a bimetallic strip and in the operating condition of the lamp is connected electrically to one of the main electrodes only, the bimetallic strip being situated near the other main electrode and said auxiliary external ignition means in the inoperative condition of the lamp bearing against the discharge vessel over substantially its entire length, whereas in the operating condition of the lamp the auxiliary ignition means is remote from the discharge vessel at least for the greater part due to the action of the bimetallic strip, characterized in that the said bimetallic strip is the only member moving the auxiliary external ignition means.

2. A high-pressure discharge lamp as claimed in claim 1, characterized in that the other end of the external ignition auxiliary means is connected to a current supply conductors of one of the main electrodes.

3. A high-pressure discharge lamp as claimed in claim 1 or 2, which discharge vessel is elongate, characterized in that in the inoperative condition of the lamp the external ignition auxiliary means forms at most half a turn around the discharge vessel and the direction of movement of the bimetallic strip is such that at least a part of said auxiliary external ignition means stays within a plane parallel to the longitudinal axis of the discharge vessel, throughout the travel thereof the orientation of the bimetal being such that when the temperature rises, bending of the ignition auxiliary means takes place.

4. A high-pressure discharge lamp as claimed in claim 1 or 2, which discharge vessel is elongate, characterized in that in the inoperative condition of the lamp the external ignition auxiliary means forms at most three quarters of a turn around the discharge vessel, that the direction of movement of the bimetallic strip is substantially perpendicular to the longitudinal axis of the discharge vessel, and that the orientation of the bimetallic strip is such that when the temperature rises, bending of the ignition auxiliary means takes place.

5. A high-pressure discharge lamp as claimed in claim 1, 2, 3 or 4, characterized in that the lamp has a series arrangement consisting of an electric contact operated by the bimetallic strip and a glow starter which in the inoperative condition of the lamp interconnects the two main electrodes electrically via the bimetal, and that in the operating condition of the lamp the interconnection is broken due to the action of the bimetallic strip.

6. A high-pressure discharge lamp as claimed in claim 1, 2, 3, 4 or 5, characterized in that it is a high-pressure sodium vapour discharge lamp and that the discharge vessel contains xenon which at a temperature of 300 K has a partial gas pressure exceeding 15,000 Pa (120 Torr).

* * * * *